United States Patent [19]

Murayama

[11] 4,388,123

[45] Jun. 14, 1983

[54] METHOD FOR THE MANUFACTURE OF STEEL SUITABLE FOR ELECTRIC-WELDED TUBULAR PRODUCTS HAVING SUPERIOR RESISTANCE TO SOUR GAS

[75] Inventor: Hiroshi Murayama, Tokai, Japan

[73] Assignee: Nippon Steel Corporation, Tokyo, Japan

[21] Appl. No.: 297,971

[22] Filed: Aug. 31, 1981

[30] Foreign Application Priority Data

Sep. 5, 1980 [JP] Japan ..... 55-122221

[51] Int. Cl.[3] ..... C21D 8/02

[52] U.S. Cl. ..... 148/12 F; 148/12.4; 148/36

[58] Field of Search ..... 148/36, 12 F, 12.4; 75/124, 123 J

[56] References Cited

U.S. PATENT DOCUMENTS

| | | | |
|---|---|---|---|
| 3,539,404 | 11/1970 | De Retana | 148/12.4 |
| 3,726,723 | 4/1973 | Coldren et al. | 148/36 |
| 4,137,104 | 1/1979 | Nashiwa et al. | 148/12 F |
| 4,153,454 | 5/1979 | Emi et al. | 75/124 |
| 4,184,898 | 1/1980 | Ouchi et al. | 148/12 F |

OTHER PUBLICATIONS

Hamre et al., "Properties of Acicular-Ferrite Steel for Large-Diameter Line Pipe," Micro Alloying 75, Conference in Wash., DC, Oct. 1975, Session 2B, pp. 21-27.

Krishnadev et al., "Low-Temperature Mechanical Behavior of an 'Acicular' Ferrite HSLA Line Pipe Steel," Met. Trans. A, vol. 10A, Dec. 1979, pp. 1941-1944.

Grozier, "Production of Micro Alloyed Strip and Plate by Controlled Cooling," Micro-Alloying 75, Session 2A, Oct. 1-3, 1975, Wash., DC, pp. 23-32.

Pircher et al., "Controlling Inclusions in Steel by Injecting Calcium into the Ladle," Micro Alloying 75, Session 2A, Oct. 1-3, 1975, Wash., DC, pp. 15-22.

*Primary Examiner*—Peter K. Skiff

*Attorney, Agent, or Firm*—Wenderoth, Lind & Ponack

[57] ABSTRACT

A steel stock consisting, in basic composition, of C≦0.12%, 0.5-1.0% Mn, 0.10-0.25% Si, P≦0.015%, S≦0.0020%, Nb≦0.050%, 0.0010-0.0060% Ca and the remainder of Fe and negligible traces of impurities is hot rolled, this hot rolling being finished at a temperature above 870° C. The steel is then rapidly cooled on a runout table at an average cooling rate of from 5° C. to 30° C. per second, and finally, the steel is coiled at a temperature below 570° C. The steel stock has superior resistance to sour gas.

3 Claims, 5 Drawing Figures

METHOD FOR THE MANUFACTURE OF STEEL SUITABLE FOR ELECTRIC-WELDED TUBULAR PRODUCTS HAVING SUPERIOR RESISTANCE TO SOUR GAS

BACKGROUND OF THE INVENTION

A. Field of the Invention

The present invention relates to a method for producing a steel stock suitable for electric-welded steel tubular products having a superior resistance to sour gas environments where a gas such as $H_2S$ prevails, and more particularly, to a method for producing the steel stock which is suitable for electric-welded steel tubular products as hot-rolled with no heat treatment.

B. Description of the Prior Art

Since the oil crisis, oil wells have become so deep that the possibility of the oil containing a lot of hydrogen sulfide gas is now very high. In fact, crude oil containing much $H_2S$ gas is actually being pumped up for processing. Accordingly, line pipe having a strong resistance to $H_2S$ has come into strong demand and electric-welded steel tubular products having superior resistance to sour gas containing $H_2S$ are also now required by many users.

It is understood that throughout the specification the term "sour gas" refers to gas containing $H_2S$ and other S-containing gases. On the other hand, increased oil prices have made it profitable to pump oil from wells containing considerable quantities of $H_2S$ (having pH as high as 4.0). In consequence, a line pipe having a strong resistance to pH 4.0 has been strongly desired.

There is already in use a line pipe coated with Cu that is able to prevent the penetration of hydrogen in an ordinary environmental situation where the pH is 5.2. A Cu coated line pipe is, however, unable to prevent the invasion of hydrogen in an environment of pH 4.0. Therefore, it is necessary to increase resistance to sour gas by some other means. In this connection, it is known that sour gas resistance can be enhanced by subjecting an electric-welded tube to quenching and tempering. This, however, leads to another disadvantage, namely, a rise in processing cost.

SUMMARY OF THE INVENTION

It is the principal object of the present invention to provide a method for producing a steel stock suitable for electric-welded tubular products having superior resistance to sour gas containing $H_2S$.

Another object of the invention is to provide a method for producing a hot-rolled steel stock which, without being subjected to heat treatment, has superior resistance to sour gas as well as a good electric weldability.

BRIEF DESCRIPTION OF THE DRAWINGS

Other and further objects of the invention will be better understood from the following description with reference to the accompanying drawings in which.

DETAILED DESCRIPTION OF THE INVENTION

Figure 1:
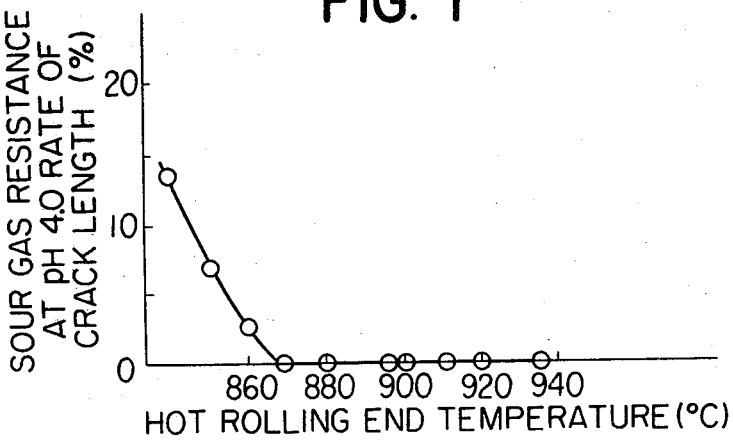
FIG. 1 is a diagram showing the relation between hot rolling end temperature and sour gas resistance (expressed as the rate of crack length)

The present invention consists in a method for producing a steel stock suitable for electric-welded tubular products having superior resistance to sour gas, characterized by the steps of subjecting a steel composition consisting, in its basic composition, of $C \leqq 0.12\%$, 0.5–1.0% Mn, 0.10–0.25% Si, $P \leqq 0.015\%$, $S \leqq 0.0020\%$, $Nb \leqq 0.050\%$, 0.0010–0.0060% Ca and the remainder of Fe and unavoidable and negligible traces of impurities to hot rolling step, finishing the hot rolling step at a temperature above 870° C., force cooling the rolled sheet or a runout table at an average cooling rate of from 5° C. to 30° C. per second, and finally, coiling the steel at a temperature below 570° C.

In the method for producing a steel stock for use in electric-welded tubular products in accordance with the present invention, an acicular ferritic structure is formed in a low Mn steel by rapid cooling it on a runout table. The acicular ferritic structure gives the steel remarkable resistance to the propagation of cracks, a property that increases its resistance to sour gas. Then by coiling the steel at a low temperature, the formation of a pearlitic band structure which would have the adverse effect of promoting crack propagation is inhibited. Thus, a steel suitable for electric-welded tubular products having excellent resistance to sour gas can be produced.

As regards the chemical composition of the steel of this invention, C is required so that the steel will have the required strength but if C exceeds 0.12%, an intermediate structure is generated by the force cooling after hot rolling. This has an undesirable effect on the sour gas resistance, ductility, toughness and weldability. Mn is also required to give the steel the required strength and if the Mn content is less than 0.5%, there is an undesirable deterioration of toughness. On the contrary, an Mn content exceeding 1.0% has an adverse effect on the sour gas resistance since it causes an increase in both pearlitic band structure and segregation. Si is also necessary in order to secure required strength. As is well known, because of Si/Mn relationship, a minimum Si content of 0.10% is required to inhibit the formation of penetrator at the weld region of electric-welded tube produced from the stock steel. At the optimum balance of Mn/Si, no penetrator is formed because $SiO_2$ separates the unsaturated $FeO\text{-}MnO\text{-}SiO_2$ melts but if Si exceeds 0.25%, the weldability of the steel is degraded owing to the separation of solid $SiO_2$. Accordingly, the Si content should be in the range of 0.10–0.25%.

Since P deteriorates the sour gas resistance due to segregation, it is desired to be held to the lowest content possible. Specifically, if it exceeds 0.015%, it is particularly undesirable. Presence of S is also undesirable, because the sour gas resistance is lowered by the inclusion of elongated MnS. An S content exceeding 0.0020% is particularly undesirable.

Nb is required to secure the required strength but when it is present in excess of 0.050%, it gives no further increase in strength because of the rise in its solid solution temperature. Ca is added in order to transform elongated MnS to a globular form having no advserse effect on sour gas resistance. A minimum of 0.0010% is required in view of its strong affinity with oxygen. However, if the Ca content exceeds 0.0060%, there is an excess of Ca over that consumed for transforming inclusions into another form and much Ca oxide is generated, degrading both toughness and sour gas resistance.

The molten steel having the above basic composition can be a killed steel produced by any known steel-making technique in, for example, a converter, an open-hearth furnace, or an electric furnace, and further, ingot or the like can be produced from the steel by any casting method, such as, ingot casting, blooming or continuous casting.

Next, the hot rolling requirements will be explained. The relation between hot rolling end temperature and the rate of crack length, which is an indicator of the sour gas resistance is shown in FIG. 1 for a steel coiled at 570° C. It is seen in FIG. 1 that no cracks occur whatever when the end temperature exceeds 870° C. as specified in this invention. Thus, there is obtained a steel with superior resistance to sour gas.

Completion of the hot rolling at a temperature above 870° C. reduces deforming zone formation and prevents the occurrence of lamellar ferritic nuclei. Thus, the occurrence of pearlitic band structure, which accelerates the propagation of cracks, can be inhibited with a resulting improvement in the sour gas resistance.

Further, the sour gas resistance can be remarkably enhanced by subjecting the steel to rapid cooling at an average cooling rate from 5° C. to 30° C. per second on a runout table following the finishing hot rolling stand. Particularly, it is found that rapid cooling at the first stage of the runout table is especially effective in increasing the sour gas resistance attributable to the acicular ferritic structure of the steel.

Figure 2:
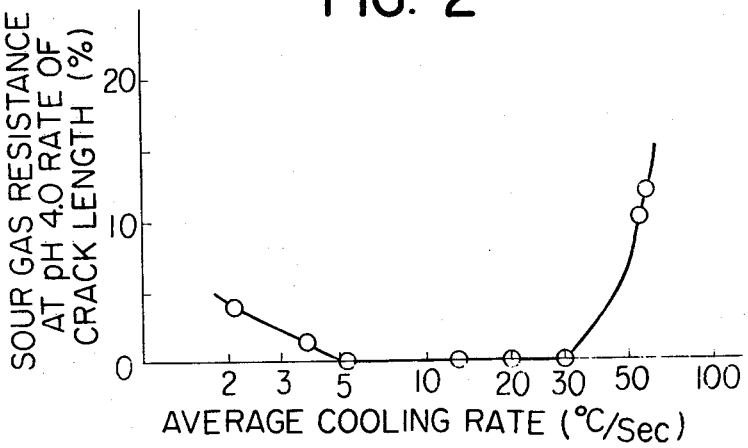
FIG. 2 is a diagram showing the relation between average cooling rate and sour gas resistance.

As illustrated in FIG. 2, when a steel with a hot rolling end temperature of 880° C. is cooled at a cooling rate of less than 5° C. per second, the sour gas resistance decreases, a result due to the appearance of pearlitic band structure. Conversely, when the steel is cooled at a cooling rate about 30° C. per second, an intermediate structure is formed so as to deteriorate the sour gas resistance. In other words, when the steel is cooled rapidly at an average cooling rate from 5° C. to 30° C. per second on the runout table, almost no pearlitic transformation takes place while, on the other hand, an acicular ferritic structure forms, and this structure prevents increased formation of pearlitic band structure.

Figure 3:
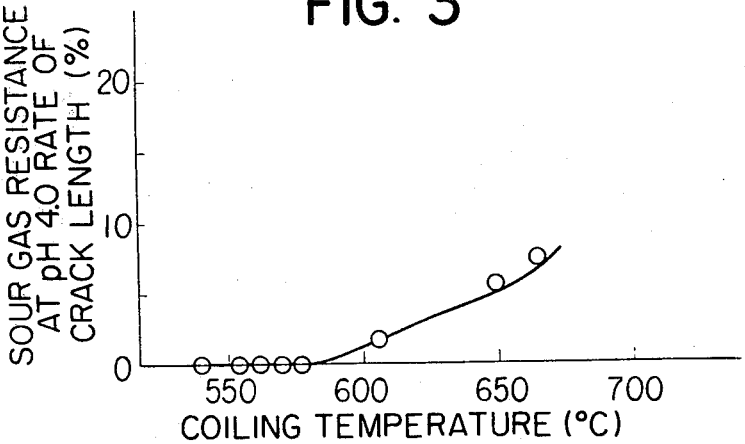
FIG. 3 is a diagram showing the relation between coiling temperature and sour gas resistance.

As indicated in FIG. 3, the sour gas resistance is also improved by coiling at a temperature below 570° C. after hot rolling with an end temperature of 880° C. It is because the progress of pearlitic transformation is inhibited by curtailing the $Ar_1$ transformation (570° C.) on the runout table where the cooling rate is sharp. As a result, deterioration of the sour gas resistance by pearlitic band structure is prevented. This can be attributed to the fact that the basic composition of the steel of this invention contains less C and Mn than known electric-welded tube. Because of this, the $Ar_1$ transformation temperature rises to become almost the same as the temperature at which the steel is coiled.

In order to merely coil a steel stock of the ordinary composition at a temperature below the $Ar_1$ transformation, it is only necessary to lower the coiling temperature below 500° C. However, if in this case the cooling rate exceeds the upper limit (30° C. per second), an intermediate structure occurs with the adverse result that the sour gas resistance is reduced.

As fully described in the foregoing, in accordance with the method of the present invention, a steel stock suitable for electric-welded tubular products having good sour gas resistance can be produced by specifying the chemical composition of the steel and the requirements for both the hot rolling and force cooling steps. In addition, in this invention, no further heat treatment, such as , quenching or tempering, is required for the finished electric-welded tube.

The present invention can be applied to either ingot or continuous cast stock, and it is more effective and more advantageous if the continuous cast steel stock is subjected to a uniform heat diffusion treatment. Besides, it is understood that the present invention can be applied not only to a steel material used for an electric-welded tube but also to a spiral-welded one.

TABLE 1

| | Chemical Composition (wt %) | | | | | | | Hot Rolling Requirements | | | Sour Gas Resistance | | |
|---|---|---|---|---|---|---|---|---|---|---|---|---|---|
| Sample | C | Mn | Si | P | S | Nb | Ca | Rolling End Temperature (°C.) | Average Cooling Rate (°C./sec) | Coiling Temperature (°C.) | pH 4.0 Crack Length Rate (%) | pH 3.0 Crack Length Rate (%) | Remark |
| A | 0.12 | 0.98 | 0.15 | 0.009 | 0.0009 | 0.015 | 0.0040 | 900 | 10 | 560 | 0 | 0 | the invention |
| B | 0.08 | 0.87 | 0.17 | 0.015 | 0.0020 | 0.030 | 0.0042 | 870 | 5 | 570 | 0 | 0 | the invention |
| C | 0.08 | 0.87 | 0.17 | 0.015 | 0.0020 | 0.030 | 0.0042 | 920 | 30 | 570 | 0 | 0 | the invention |
| D | 0.01 | 0.50 | 0.10 | 0.005 | 0.0003 | 0.040 | 0.0020 | 930 | 15 | 570 | 0 | 0 | the invention |
| E | 0.15 | 1.20 | 0.15 | 0.009 | 0.0020 | 0.018 | 0.0038 | 900 | 30 | 570 | 2 | 4 | comparison |
| F | 0.10 | 0.99 | 0.20 | 0.020 | 0.0030 | 0.020 | 0.0010 | 900 | 30 | 570 | 1 | 3 | comparison |
| G | 0.08 | 0.87 | 0.17 | 0.015 | 0.0020 | 0.030 | 0.0042 | 850 | 15 | 560 | 7 | 10 | comparison |
| H | " | " | " | " | " | " | " | 880 | 4 | 570 | 1 | 2 | comparison |
| I | " | " | " | " | " | " | " | 880 | 60 | 540 | 10 | 13 | comparison |
| J | " | " | " | " | " | " | " | 880 | 8 | 700 | 5 | 8 | comparison |

As clearly indicated in Table 1, steel samples A–D produced by the present invention exhibit remarkably better resistance to sour gas than the other conventional steel samples (E–J).

Figure 4:
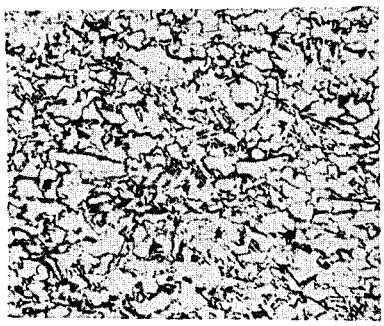
FIG. 4 is a microphotograph showing the metallic structure of a sample produced in accordance with the method of the invention (magnification: 400 times)
Figure 5:
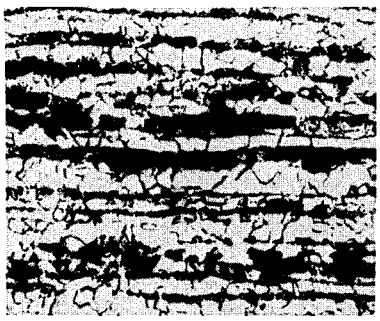
FIG. 5 is a microphotograph showing the metallic structure of another sample for comparison (magnification: 400 times).

FIG. 4 is a microphotograph (magnification: 400 times) showing that Sample C of this invention is of acicular ferritic structure. FIG. 5 is also a microphotograph (magnification : 400 times) showing that Sample J, an ordinary steel included in Table 1 for comparison, is of pearlitic band structure.

We claim:

1. In a method for producing a steel suitable for electric-welded tubular products which has a superior resistance to sour gas containing $H_2S$ and other S-bearing gases, the improvement which comprises providing a steel consisting essentially of, as a basic composition, C≦0.12 wt. %, 0.5–1.0% Mn, 0.10–0.25% Si, P≦0.015%, S≦0.0020%, Nb≦0.050%, 0.0010–0.0060% Ca, the remainder Fe and unavoidable and negligible traces of impurities, subjecting said steel to a hot rolling step, said hot rolling step being ended at a temperature above 870° C., further rapidly cooling said steel on a runout table following said hot rolling step at an average cooling rate of from 5° C. to 30° C. per second, to form an acicular ferritic structure, and finally, subjecting the steel to a coiling step at a temperature below 570° C.

2. A method as claimed in claim 1 which comprises providing a steel consisting essentially of 0.12 wt. % C, 0.98% Mn, 0.15% Si, 0.009% P, 0.0009% S, 0.015% Nb, 0.0040% Ca, the remainder Fe and unavoidable and negligible traces of impurities, hot rolling said steel, ending said hot rolling at the temperature of 900° C., rapidly cooling said steel on said runout table at an average cooling rate of 10° C. per second, to fom an acicular ferritic structure, and finally coiling said steel at the temperature of 560° C.

3. A method as claimed in claim 1 which comprises providing a steel consisting essentially of 0.01 wt. % C, 0.50% Mn, 0.10% Si, 0.005% P, 0.0003% S, 0.040% Nb, 0.0020% Ca, the remainder Fe and unavoidable and negligible traces of impurities, hot rolling said steel, ending said hot rolling at the temperature of 930° C., rapidly cooling said steel on said runout table at an average cooling rate of 15° C. per second, to form an acicular ferritic structure, and finally coiling said steel at the temperature of 570° C.

* * * * *